US008096274B2

(12) United States Patent
Vogel

(10) Patent No.: US 8,096,274 B2
(45) Date of Patent: Jan. 17, 2012

(54) ROCKER ARM ARRANGEMENT WITH A BEARING SHELL PROVIDED WITH GROOVES

(75) Inventor: Werner Vogel, Burgoberbach (DE)

(73) Assignee: MAN Nutzfahzeuge AG, München (DE)

( * ) Notice: Subject to any disclaimer, the term of this patent is extended or adjusted under 35 U.S.C. 154(b) by 307 days.

(21) Appl. No.: 12/354,211

(22) Filed: Jan. 15, 2009

(65) Prior Publication Data

US 2009/0205600 A1 Aug. 20, 2009

(30) Foreign Application Priority Data

Feb. 14, 2008 (DE) ..... 10 2008 009 170

(51) Int. Cl.
*F01L 1/18* (2006.01)

(52) U.S. Cl. ..... 123/90.39; 123/90.16

(58) Field of Classification Search ..... 123/90.39, 123/90.36, 90.46; 74/559, 569
See application file for complete search history.

(56) References Cited

U.S. PATENT DOCUMENTS

| | | | |
|---|---|---|---|
| 2,563,699 | A | 8/1951 | Winter, Jr. |
| 4,132,196 | A | 1/1979 | Wherry |
| 6,422,186 | B1 | 7/2002 | Vanderpoel |

FOREIGN PATENT DOCUMENTS

| | | |
|---|---|---|
| DE | 30 24 306 | 1/1982 |
| DE | 10 2005 040649 | 3/2007 |
| EP | 0 023 250 | 2/1981 |
| GB | 528997 | 11/1940 |
| GB | 667791 | 3/1952 |
| WO | WO 00/40840 | 7/2000 |

*Primary Examiner* — Zelalem Eshete
(74) *Attorney, Agent, or Firm* — Cozen O'Connor

(57) ABSTRACT

Rocker arm arrangement of an internal combustion engine has a bearing journal with a central axis and an outside circumferential surface running in the central bore of a rocker arm lined with a bearing shell. The bearing journal has a first transverse oil channel leading to at least one outlet at the running surface underneath the central axis. The bearing shell has an outer shell surface and an inner shell surface. The inner shell surface has a circumferentially extending internal groove, both ends of which terminate underneath the central axis, this groove extending to the outlet of the first oil channel when the rocker arm is in its base position. The outer shell surface has at least one circumferentially extending external groove, which extends as far as an inlet of a second oil channel passing through the rocker arm. At least one through-opening connects the internal groove and the external groove.

7 Claims, 2 Drawing Sheets

ROCKER ARM ARRANGEMENT WITH A BEARING SHELL PROVIDED WITH GROOVES

BACKGROUND OF THE INVENTION

1. Field of the Invention

The invention pertains to a rocker arm arrangement of an internal combustion engine with a rocker arm and a bearing journal, where the bearing journal has an outside circumferential surface formed as a running surface and fits into a central bore of the rocker arm, which is lined with a bearing shell, so that the rocker arm is supported pivotably on the running surface of the bearing journal. The bearing journal has a first oil channel passing through its interior, which channel leads to at least one outlet at the running surface underneath the center longitudinal axis of the bearing journal. The bearing shell, which is permanently connected to the rocker arm, has a hollow cylindrical form with an outer shell surface and an inner shell surface.

2. Description of the Related Art

In the rocker arm arrangements of this type in current use, the bearing shell, which is also called a bearing bush, has internal grooves in its inner shell surface, i.e., in the inside circumferential surface facing the interior of the hollow cylinder. These grooves are connected to the first oil channel of the bearing journal. These grooves in the inside surface of the bearing shell are responsible for lubricating the running surface and also for distributing the lubricating oil to second oil channels, which extend inside the rocker arm and conduct the lubricating oil to secondary consumers. The latter include, for example, the contact point between the ball pressure unit mounted in the rocker arm and the tappet push rod and/or the components of an EVB (Exhaust Valve Brake), at least some of which are also installed in the connecting mechanism between the camshaft and the exhaust valves of an internal combustion engine.

When the play increases and/or under load, the gap between the bearing shell and the running surface of the bearing journal becomes larger in the area of the bearing facing away from the load, that is, in the area of the upper half of the bearing shell. In conjunction with the internal grooves, this enlarged gap leads to the loss of oil in the axial direction in the currently used rocker arm arrangements.

SUMMARY OF THE INVENTION

The goal of the invention is to provide a rocker arm arrangement of the type indicated above which loses only a very small amount of oil.

To achieve this goal, the lower half of the inner shell surface is provided with at least one internal groove, which extends in the circumferential direction and both ends of which terminate underneath the center longitudinal axis. This groove extends at least into an area where the outlet of the first oil channel is located when the rocker arm is in its base position. The outer shell surface, furthermore, is also provided with at least one external groove, which extends in the circumferential direction as far as an inlet of a second oil channel passing through the rocker arm. The bearing shell has at least one through-opening, which connects the internal groove and the external groove to each other.

In the inventive rocker arm arrangement, the grooves in the bearing shell extend over only part of the inside surface. Each of these internal grooves terminates underneath the center longitudinal axis, that is, underneath a horizontal plane passing through the center longitudinal axis. They serve primarily to lubricate the running surface. In the inventive rocker arm arrangement, furthermore, there are also external grooves, which are connected to the one or more internal grooves and which are intended to supply oil to the secondary consumers connected to the second oil channels. This division is advantageous. Thus the internal and external grooves can thus be designed differently to serve their intended purposes more effectively.

This measure is also advantageous with respect to the loss of oil which otherwise occurs under load. Because the internal grooves already terminate underneath the center longitudinal axis, the effect of a load exerted by the bearing journal is to seal off the internal grooves even more effectively, since the journal is pressed down even more strongly against the lower half of the bearing shell. The gap between the shell and the bearing journal which becomes larger under the effect of load in the area of the upper half of the bearing shell does not lead in the case of the inventive rocker arm arrangement to any significant increase in the loss of oil. This area, in contrast to the prior art, is not supplied with oil. The internal grooves terminate before that, that is, before they leave the lower half. The external grooves, which can extend in particular into this area of the upper half of the central bore of the rocker arm to supply oil to the inlets of the second oil channels, which will also be located in the upper half, are separated from the gap which has become larger under load by the wall of the bearing shell, which is uninterrupted especially in this area. The same advantageous oil-saving behavior is obtained when the bearing play increases over time as a result of, for example, aging phenomena.

According to a favorable variant, the first oil channel comprises a transverse bore, which passes completely through the bearing journal and extends underneath the center longitudinal axis. As a result, there are two outlets at the running surface connected to the one or more internal grooves. This improves the supply of oil to the internal grooves.

According to another advantageous variant, the inlet is located in an inside wall of the central bore of the rocker arm above the center longitudinal axis, and the external groove begins underneath the center longitudinal axis and ends above the center longitudinal axis, where it extends at least as far as the inlet. With this design, the advantages attributable to the separation into internal and external grooves are especially pronounced.

At least two second oil channels, furthermore, are located in the rocker arm, and the outside surface of the shell is provided with at least two external grooves, where each external groove is assigned to only one of the inlets of the second oil channels. Thus the oil supply can be adapted effectively to the amount of oil required by each of the secondary consumers connected to the second oil channels.

This is also true for another preferred embodiment, according to which the external grooves have different groove geometries to at least some extent, especially different depths and/or widths. In this way, too, it is possible effectively to adjust the oil throughput in each external groove to the specific requirements.

According to another favorable variant, the through-opening in the bearing shell is located in the area where the outlet of the first oil channel is located when the rocker arm is in its base position. This provides the best possible oil supply or at least a very good oil supply to the secondary consumers. The oil can pass directly from the first oil channel into the external groove or grooves, that is, in particular, it does not have to make a long detour via the internal groove or grooves.

It is also preferable for both the internal groove and the external groove to be made as pressed grooves. A bearing shell pressed on both sides in this way can be easily produced at low cost. In the case of a bearing shell normally produced in any case by stamping and/or rolling, the additional external grooves do not call for any significant increase in the amount of work involved in producing the shell, which is now simply stamped on both sides.

Additional features, advantages, and details of the invention can be derived from the following description of an exemplary embodiment on the basis of the drawings.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
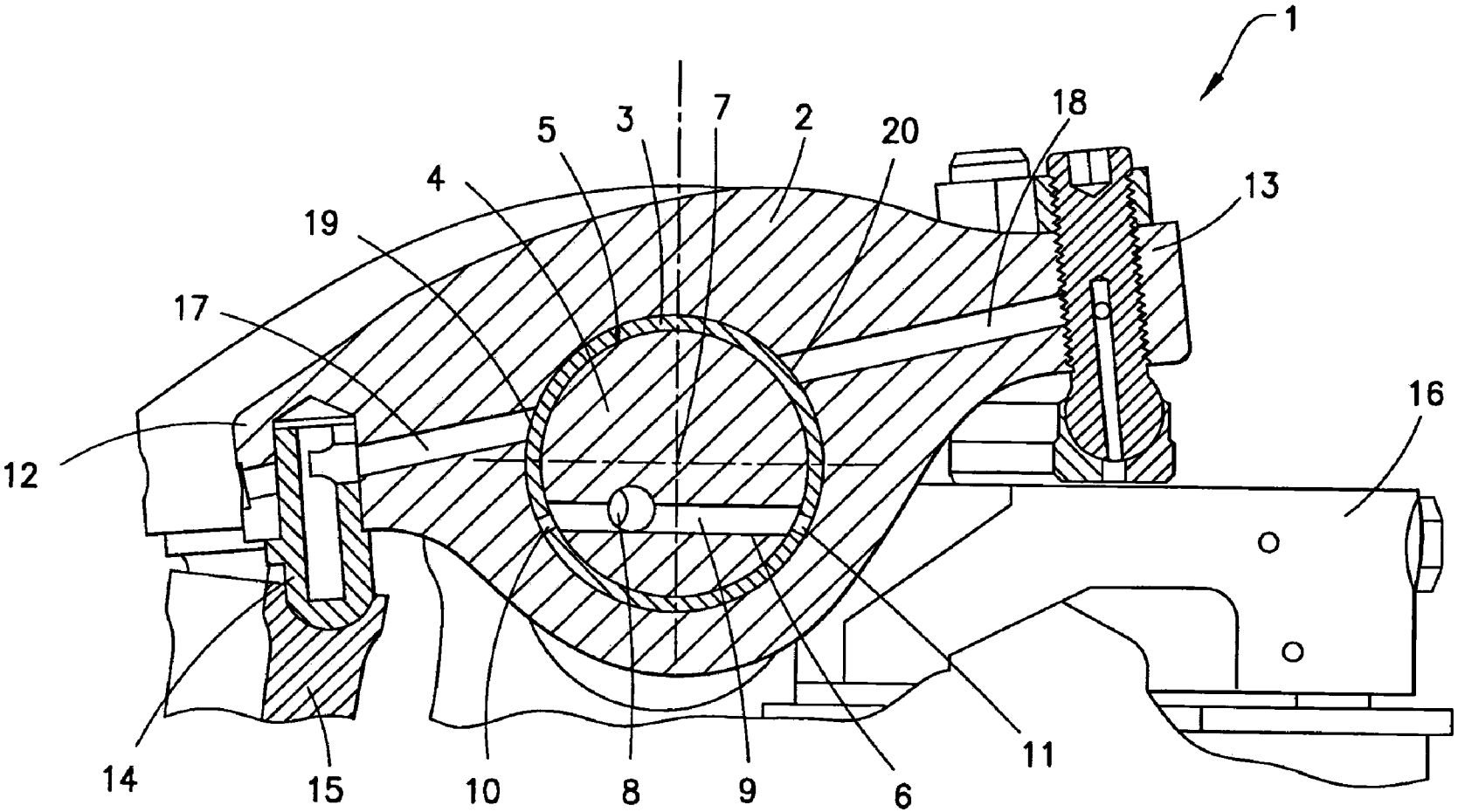
FIG. 1 shows an exemplary embodiment of a rocker arm arrangement of an internal combustion engine with a bearing shell, which comprises internal and external oil-conducting grooves.
Figure 2:
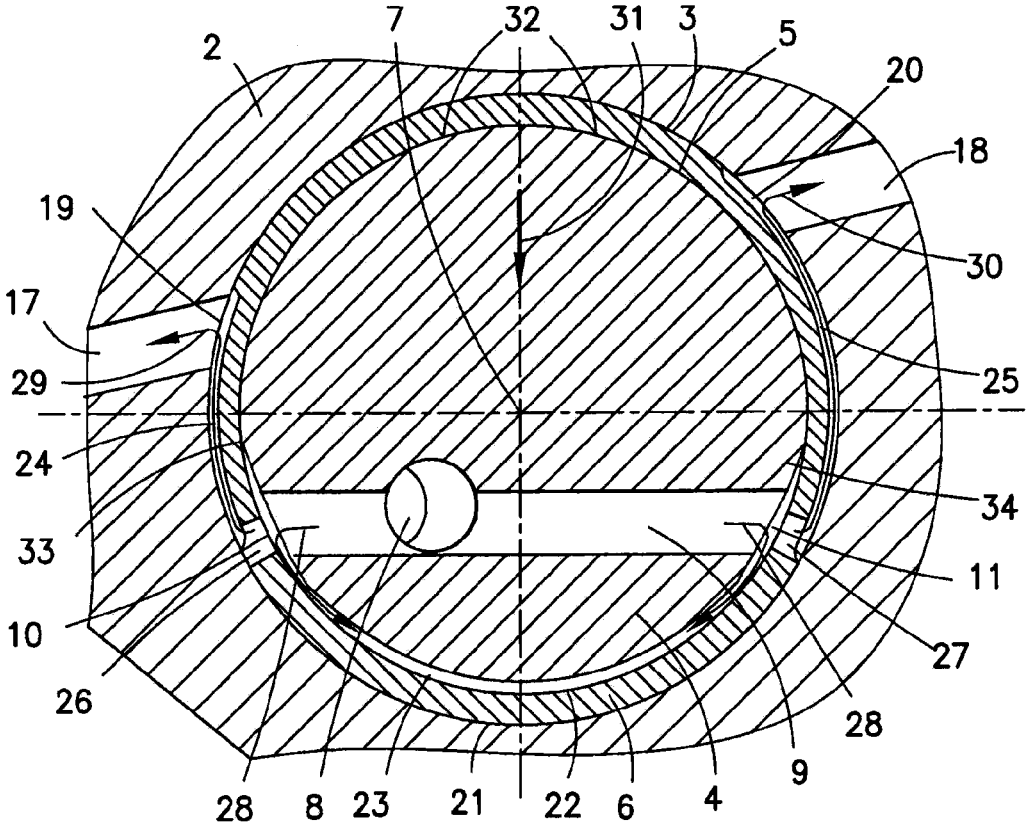
FIG. 2 shows an enlarged view of the rocker arm bearing of the rocker arm arrangement according to FIG. 1.

Corresponding parts in FIGS. 1 and 2 are designated by the same reference numbers.

FIGS. 1 and 2 show an exemplary embodiment of a rocker arm arrangement 1 of an internal combustion engine (not shown). It includes a rocker arm 2 with a central bore 3 and a bearing journal 4, the outside circumferential surface of which represents a bearing or running surface 5, on which the rocker arm 2 is rotationally-pivotably supported by means of a bearing shell 6. The bearing shell 6 is for this purpose pressed into the central bore 3 of the rocker arm 2, so that a tight mechanical connection is established between these two components. The running surface 5 of the bearing journal 4 fits into the bearing shell 6, where the bearing shell 6 is seated on the bearing journal 4 with freedom to rotate/pivot around a center longitudinal axis 7 of the bearing journal 4.

A longitudinal oil channel 8 extends through the inside of the bearing journal 4 in the axial direction, that is, in the direction parallel to the center longitudinal axis 7; the channel is off-center and located in the lower half of the bearing journal 4. A transverse oil channel 9 branches off from this longitudinal channel 8 and proceeds toward the running surface 5 in the area of each rocker arm 2. The transverse oil channel 9 is designed as a transverse bore, which passes completely through the bearing journal 4 and leads to two outlets 10, 11 in the running surface 5. The transverse oil channel 9, like the longitudinal oil channel 8, passes underneath the center longitudinal axis 7, i.e., underneath a horizontal plane comprising the center longitudinal axis 7. The two outlets 10, 11 are also located in the lower half of the bearing journal 4.

The rocker arm 2 has two lever-action arms 12, 13. One of these arms is connected mechanically to a camshaft (not shown) by means of a ball pressure unit 14, which is pressed onto this lever arm 12, and a tappet push rod 15. The other lever arm 13 is mechanically connected to a valve bridge 16. The valve bridge 16 actuates two cylinder valves (not shown) of the internal combustion engine. An oil channel 17, 18 passes through each of the lever arms 12, 13 to supply oil to the valve bridge 16, to the hydraulically operated components connected to it, and to the ball pressure unit 14, these representing the secondary consumers of oil. Each of the oil channels 17, 18 has an inlet 19, 20 in the inside wall of the central bore 3; these inlets are located in the upper half of the central bore 3 of the rocker arm 2, i.e., above the center longitudinal axis 7.

The bearing shell 6 tightly connected to the rocker arm 2 is designed as a hollow cylinder, which has an outer shell surface 21 on the outside, which forms the outside circumferential surface of the hollow cylinder, and an inner shell surface 22 on the inside, which forms the inside circumferential surface, i.e., the surface facing the interior space of the hollow cylinder. As a result of the press-fit connection, the outer shell surface 21 of the bearing shell 6 rests directly and tightly against the inside wall of the central bore 3 of the rocker arm 2 in the assembled state.

The lower half of the inner shell surface 22 is provided with an internal groove 23, both ends of which terminate below the center longitudinal axis 7, i.e., again underneath the horizontal plane passing through the center longitudinal axis 7. This groove extends in the circumferential direction, and, when the rocker arm 2 is in its base position shown in FIGS. 1 and 2, both ends extend slightly beyond the associated outlets 10, 11 of the transverse oil channel 9. The transverse oil channel 9 is connected to this internal groove 23 by its two outlets 10, 11 and thus supplies the internal groove, at least when the rocker arm 2 is in its base position, with oil at both ends. In this base position, in which the push rod is resting on the base circle of the camshaft and the valves actuated by way of the valve bridge 16 are closed, the two outlets 10, 11 are next to the internal groove 23.

The outer shell surface 21 is provided with external grooves 24, 25, which also extend in the circumferential direction. Each begins in the lower half of the central bore 3 and extends through the upper half of the central bore 3 to a point slightly beyond its associated inlet 19, 20. The inlets 19, 20 of the oil channels 17, 18 are connected to the external grooves 24, 25. Each of the external grooves 24, 25 supplies oil to the oil channel 17, 18 assigned to it.

The internal groove 23 is connected to each of the two external grooves 24, 25. For this purpose, through-openings 26, 27, designed as through-bores, are provided in the bearing shell 6. Each of the through-openings 26, 27 is opposite one of the two outlets 10, 11 of the transverse oil channel 9 when the rocker arm 2 is in its base position.

The way in which the rocker arm arrangement 1 works and its particular advantages are described in greater detail below.

The oil supplied by the transverse oil channel 9 is needed, first, to lubricate the running surface 5 and, second, to supply the secondary consumers connected to the oil channels 17, 18. For these two tasks, essentially separate systems are provided in the rocker arm arrangement 1. The oil supplied to the running surface 5 arrives via the internal groove 23. A corresponding partial oil flow route 28 leads directly from the outlets 10, 11 into the internal groove 23. In contrast, the external grooves 24 and 25 are provided to supply oil to the secondary consumers. The associated partial oil flow routes 29, 30 lead from the outlets 10, 11 via the through-openings 26, 27, the external grooves 24, 25, and the inlets 19, 20 into the oil channels 17, 18. The oil throughput for the oil supply to the secondary consumers can be effectively adapted to the specific requirements of the individual secondary consumer connected to one of the external grooves 24, 25 by selecting the appropriate geometry of the groove, which can be specified individually. For example, the depth or the width of the individual groove can be specified. The two external grooves 24, 25 can therefore have geometric parameters which differ from each other.

The grooves 23-25 provided in the rocker arm arrangement 1 both on the inside surface and on the outside surface of the bearing shell 6 and especially the special geometric arrangement of these grooves have a favorable effect on operating situations during which, under the action of load, for example, the bearing journal 4 moves in the direction of the arrow 31. When this happens, a gap 32 forms between the running surface 5 and the inner shell surface 22 of the bearing shell 6 in the area of the upper half of the bearing journal 4. A gap such as this can also form over the operating life of the arrangement as a result of an increase in bearing play. In the case of conventional rocker arm arrangements, a gap such as this leads to a loss of oil, which must be compensated by an oil supply system of appropriate capacity.

The rocker arm arrangement 1, however, is designed in such a way that this loss of oil does not occur or at least does not occur to any significant degree. When the bearing journal 4 moves in the direction of the arrow 31, the lateral areas 33 and 34 of the running surface 5 have the effect of sealing off the internal groove 23 from the gap 32 forming in the upper half. These lateral areas are located approximately at the level of the center longitudinal axis 7, and in any case they are located above the two upper ends of the internal groove 23. As a result, oil is prevented from escaping axially through this gap 32.

At the same time, however, the oil supply to the running surface 5 by means of the now especially well-sealed internal groove 23 and also the oil supply to the secondary consumers by means of the external grooves 24 and 25 still remain guaranteed. The rocker arm arrangement 1 is therefore characterized by an extremely low level of oil loss, especially in situations where a load is acting on the bearing journal 4, but also in cases where the bearing play has increased for some other reason.

The invention is not limited by the embodiments described above which are presented as examples only but can be modified in various ways within the scope of protection defined by the appended patent claims.

I claim:

1. A rocker arm arrangement for opening valves situated below the arrangement, the arrangement comprising:

a rocker shaft forming a bearing journal having a central axis and a running surface, the journal having a first traverse oil channel below the central axis and leading to at least one outlet on the running surface;

at least one rocker arm mounted on said rocker shaft for pivoting about said central axis from a base position to an actuating position in which a corresponding valve is open, each said rocker arm having a central bore and a second transverse oil channel having at least one inlet on the central bore; and a bearing shell press-fit into each said bore, each said bearing shell having an inner shell surface and an outer shell surface, the inner shell surface having a circumferentially extending internal groove having opposite ends which terminate below said central axis, at least one of said ends extending to a respective said at least one outlet when the rocker arm is in said base position, the outer shell surface having at least one circumferentially extending external groove extending to a respective said at least one inlet, the bearing shell having at least one opening connecting the internal groove to a respective said at least one said external groove.

2. The rocker arm arrangement of claim 1 wherein the first transverse oil channel passes completely through the bearing journal and leads to two outlets on the running surface.

3. The rocker arm arrangement of claim 1 wherein said at least one inlet is above the central axis when the rocker arm is in said base position, each said external groove extending from a respective said inlet to a respective said opening, wherein said opening is below said central axis.

4. The rocker arm arrangement of claim 1 wherein said second transverse oil channel passes through said rocker arm and has two inlets on said central bore, the outer shell surface having two said external grooves extending to respective said inlets.

5. The rocker arm arrangement of claim 4 wherein said external grooves have different geometries.

6. The rocker arm arrangement of claim 1 wherein each said opening communicates with a respective said outlet when said rocker arm is in said base position.

7. The rocker arm arrangement of claim 1 wherein said internal groove and said at least one external groove are stamped into respective said shell surfaces.

* * * * *